US010337132B1

(12) United States Patent
Mathis

(10) Patent No.: US 10,337,132 B1
(45) Date of Patent: Jul. 2, 2019

(54) DEVICE TO REMOVE PILLED FABRIC

(71) Applicant: Peggy Mathis, Lebanon, TN (US)

(72) Inventor: Peggy Mathis, Lebanon, TN (US)

( * ) Notice: Subject to any disclaimer, the term of this patent is extended or adjusted under 35 U.S.C. 154(b) by 250 days.

(21) Appl. No.: 15/179,671

(22) Filed: Jun. 10, 2016

(51) Int. Cl.
*B26B 13/00* (2006.01)
*D06C 29/00* (2006.01)

(52) U.S. Cl.
CPC ..... *D06C 29/00* (2013.01)

(58) Field of Classification Search
CPC ..... D06C 29/00
USPC ..... 30/233.5, 194
See application file for complete search history.

(56) References Cited

U.S. PATENT DOCUMENTS 4,899,442 A 2/1990 Horii et al.
4,985,999 A 1/1991 Iwasaki et al.
D319,564 S 9/1991 Okayasu
D321,115 S 10/1991 Henry
5,575,031 A 11/1996 Chai
D495,831 S 9/2004 Hsu
6,941,662 B2 9/2005 Chen
D524,487 S * 7/2006 Seki ..... D28/54
D558,400 S * 12/2007 Micinilio ..... D28/54
7,647,699 B1 1/2010 Geile
D620,643 S 7/2010 Teteak et al.
D654,220 S 2/2012 Cole
D678,611 S 3/2013 Hsu
8,844,142 B2 * 9/2014 Kammer ..... B26B 19/3846 30/201
2008/0184565 A1 * 8/2008 Zoot ..... B26B 19/22 30/196
2011/0308035 A1 12/2011 Casper
2012/0263911 A1 10/2012 Tao et al.
2014/0310963 A1 * 10/2014 Geiser ..... B26B 19/3846 30/233.5

* cited by examiner

*Primary Examiner* — Omar Flores Sanchez
(74) *Attorney, Agent, or Firm* — Bradley Arant Boult Cummings; Phillip E. Walker; Timothy L. Capria

(57) ABSTRACT

The present disclosure relates generally to a device for the removal of pills from the surface of the fabric. The device can comprise a body having a top end, bottom end, a first side, and a second side. A blade can be positioned at the top end of the body with the blade having a plurality of upper teeth and a plurality of lower teeth. A motor can be positioned within the body and can be operatively attached to the blade and a power source. A guide can be attached to the top end of the body and can include a base that is wider than the top end and first and second armatures spaced on opposite sides of the base. Each armature can extend from the base in a direction substantially parallel to the other armature. A connector is attached to the armatures opposite the base wherein the base, first and second armatures, and the connector define an opening position to accept part of the blades.

18 Claims, 9 Drawing Sheets

DEVICE TO REMOVE PILLED FABRIC

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

FIELD OF INVENTION

The current disclosure relates to a device used to remove pilled fabric. This fabric can also be described as fuzz or material clumping. The device can be typically used with clothing but can be used with a multitude of fabrics.

BACKGROUND OF THE INVENTION

Several types of fabric have a tendency to "pill" on the exterior surface of the fabric. For example, fabrics made of wool, silk, nylon, etc., will produce piles or pillies after wear or use. These piles typically are not aesthetically pleasing and can cause an apparent problem to the owner of the fabric. This is especially true in clothing and the owner/wearer of the clothing. Numerous attempts of prior art have been made to try to design a device that removes these pills, or entangled fiber strands from the surface of the fabrics.

Most of the prior art has been directed at clippers, adhesives, or a straight-type razor blade. The straight-type razor blade has simply cut the pilling as it would cut the hairs on the skin. This has issues with too much pressure can cut portions of the fabric and ruin the fabric.

The adhesive devices typically have a sheet, or roller form. A user would press the sheet or roll the circular adhesive across the surface picking up the piled pieces. Drawbacks to this include potential additional damage to the fabric by causing additional pilling of the fabric and insufficient removal of the pills already there.

The handheld clipping devices typically have a battery powered or electrical powered motor that rotates spinning blades about an axis. A cover is usually placed over the blades to protect the fabric and user from the spinning blades. These devices have drawbacks in their effectiveness to actually reach and cut the pills as well as the amount of pilling left due to the lack of access by the spinning blades to the fabric surface by the cover used in these devices.

Examples of these prior arts can be found in the following patents and published patent applications: U.S. Pat. Nos. 4,899,442; 4,985,999; 5,575,031; 6,941,662; 7,647,699; 2011\0308035; U.S. Publication No. 2012\0263911; U.S. Design Pat. D319,564; D321,115; D495,831; D620,643; D654,220; D678,611.

Some of the rotary head devices also have a problem of collection of the cut piles and their proximity to the rotating elements of the devices. This can clog the devices and reduce effectiveness and can lead to malfunctioning of the device.

What is needed is a new device for the removal of piled material from fabric. Preferably this improved device allows for a controlled removal of the piled material from the fabric while protecting the remainder of the fabric from damage. This needed device is lacking in the art.

BRIEF SUMMARY OF THE INVENTION

The present disclosure relates generally to a device for the removal of pills from the surface of the fabric. The device can comprise a body having a top end, bottom end, a first side, and a second side. A blade can be positioned at the top end of the body with the blade having a plurality of upper teeth and a plurality of lower teeth. A motor can be positioned within the body and can be operatively attached to the blade. A power source can be operatively attached to the motor and a guide can be attached to the top end of the body. A guide can include a base that is wider than the top end and first and second armatures spaced on opposite sides of the base. Each armature can extend from the base in a direction substantially parallel to the other armature. A connector is attached to the armatures opposite the base wherein the base, first and second armatures, and the connector define an opening position to accept part of the blades.

In an embodiment, the opening is a position to accept the plurality of upper teeth and the plurality of lower teeth of the blades wherein the plurality of upper teeth and lower teeth extend from the top end of the body. The plurality of lower teeth can be comprised of ceramic material and can translate with respect to the plurality of upper teeth.

The guide can include a topside and a bottom side with the plurality of lower teeth being substantially flush with the bottom side of the guide. The guide can further include a guide attachment location and the top end of the body includes a device attachment location. The guide attachment location on the guide is shaped to securely engage the device attachment location on the body to attach the guide to the top end of the body. The guide can further include a release area positioned proximate to the guide attachment location. The release area is positioned and shaped to accept a force from a user of the device for removal of a guide from the body. Additionally, the first and second armatures can each include at least one raised surface that extends from approximately the base to the connector.

It is therefore a general object of the current disclosure to provide a device for removing pilling from fabric.

Another object of the current disclosure is to provide a device that can control the removal of pilling from fabric.

Still another object of the current disclosure is to provide a cutting device with guide used to assist in the removal of pilling from fabric.

Yet another object of the current disclosure is to provide a device that can position cutting blades proximate to a fabric and guide those cutting blades along the fabric to remove pilling and substantially reduce the possibility of cutting the fabric and substantially increase the probability of removing all pilling on the fabric.

Other and further objects, features, and advantageous of the present disclosure will be readily apparent to those skilled in the art upon reading of the following disclosure when taken in conjunction with accompanying drawings.

DETAILED DESCRIPTION OF THE INVENTION

Figure 1:
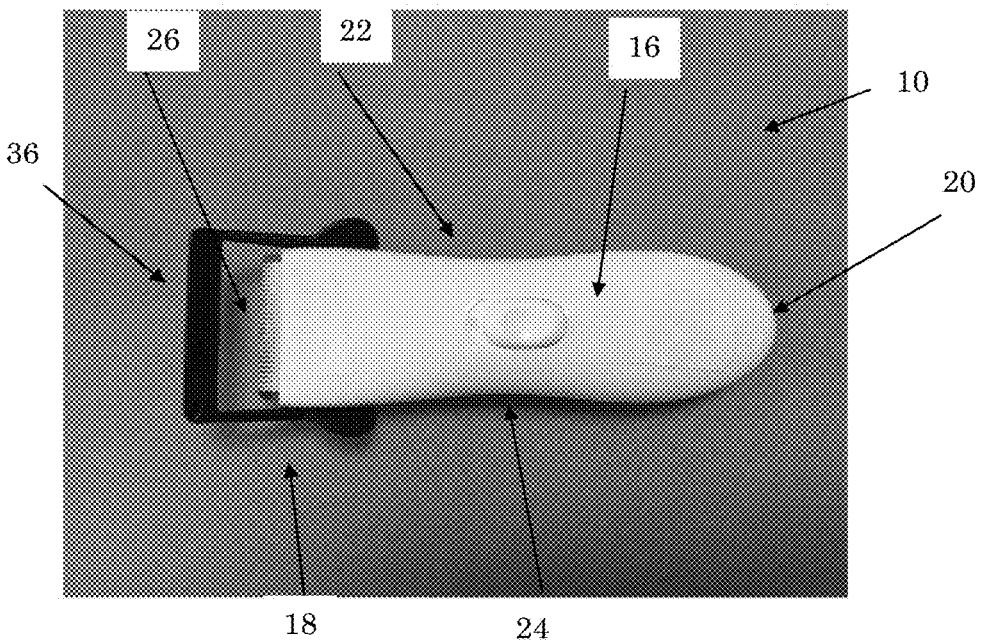
FIG. 1 shows a front perspective view of a device made in accordance with the current disclosure.
Figure 2:
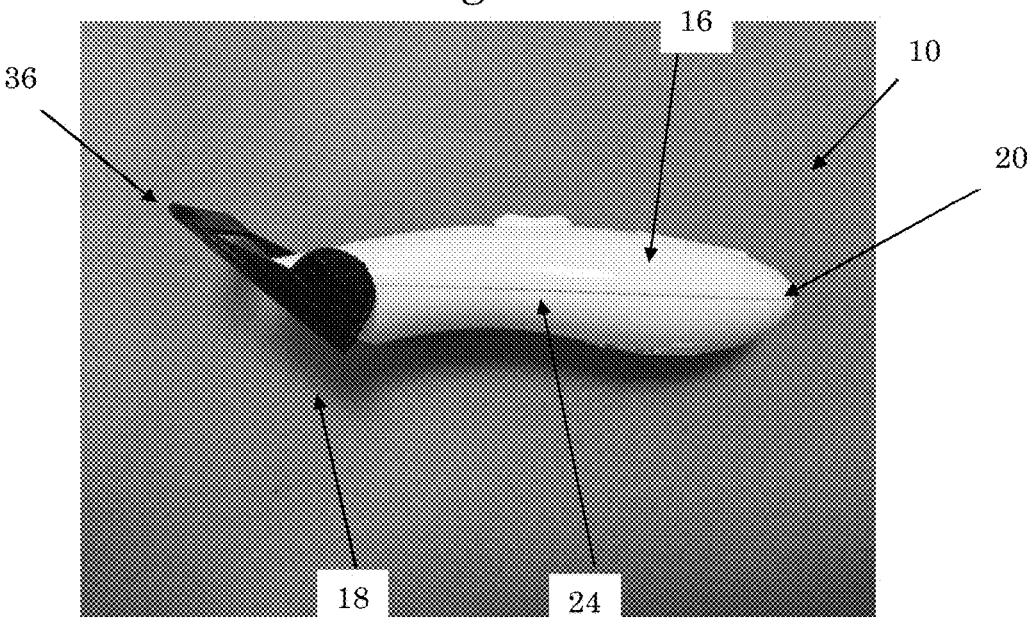
FIG. 2 illustrates a side perspective view of a device made in accordance with the current disclosure.
Figure 3:
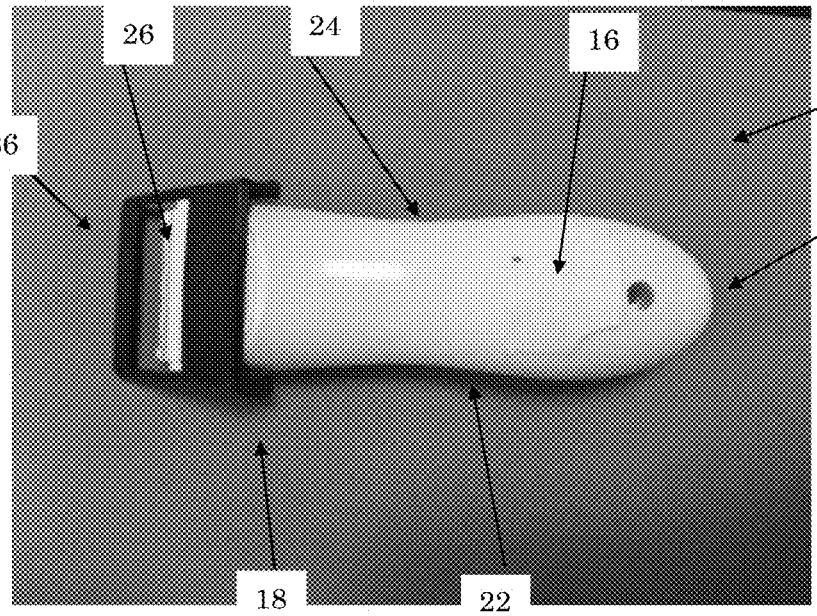
FIG. 3 is a back perspective view of a device made in accordance with the current disclosure.
Figure 4:
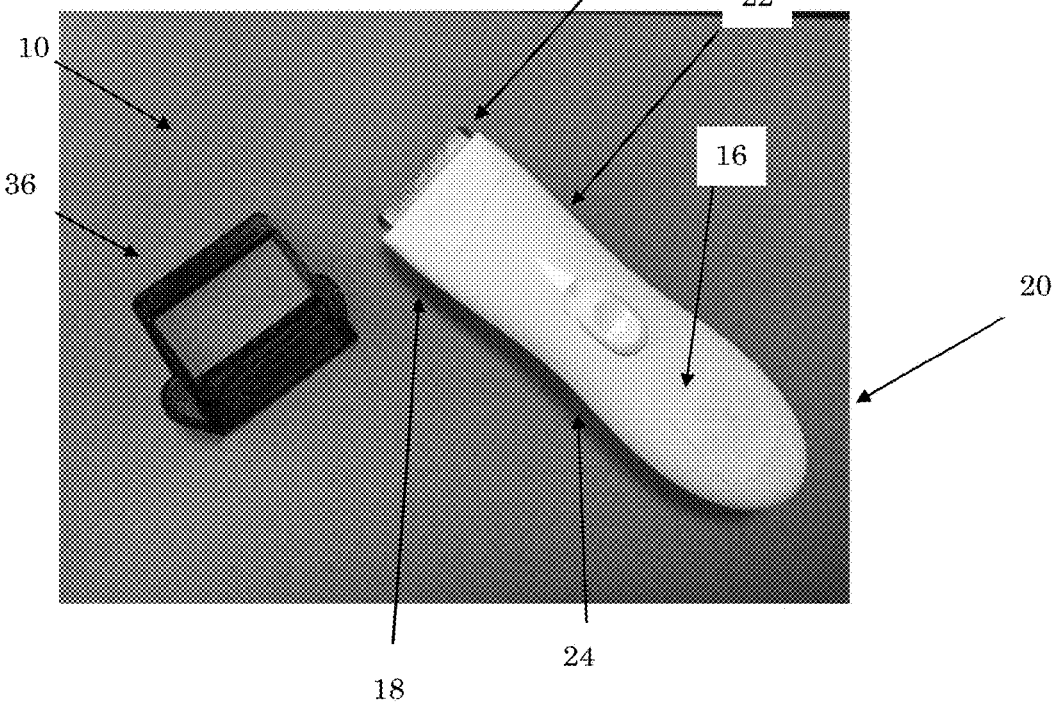
FIG. 4 is a top perspective view of a device made in accordance with the current disclosure with the guide removed from the body.
Figure 5:
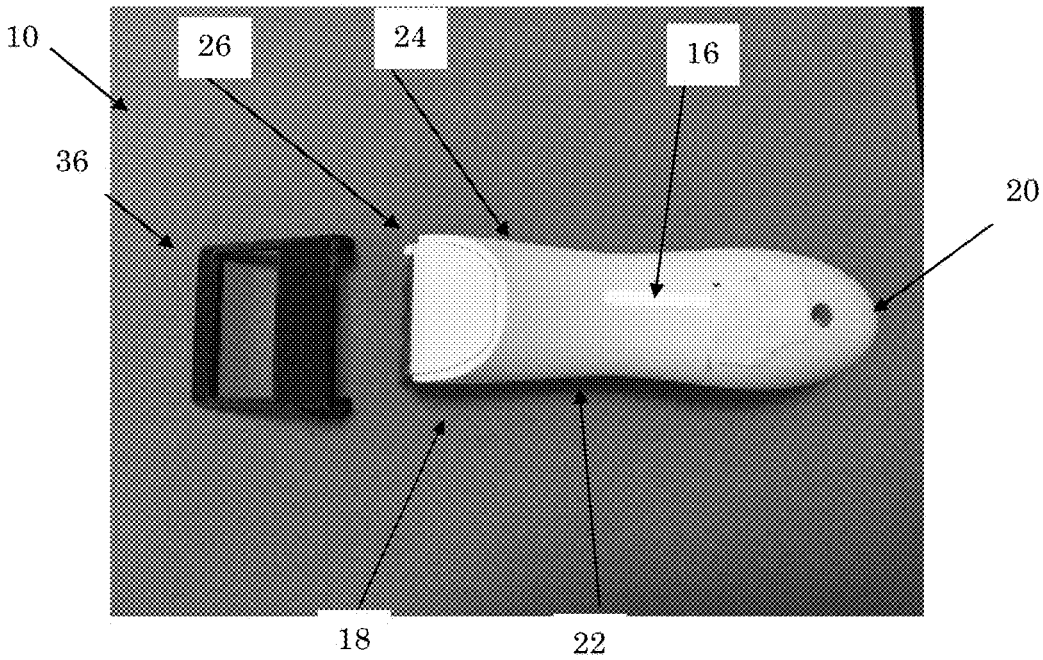
FIG. 5 is a back perspective view of a device made in accordance with the current disclosure with the guide removed from the body.
Figure 6:
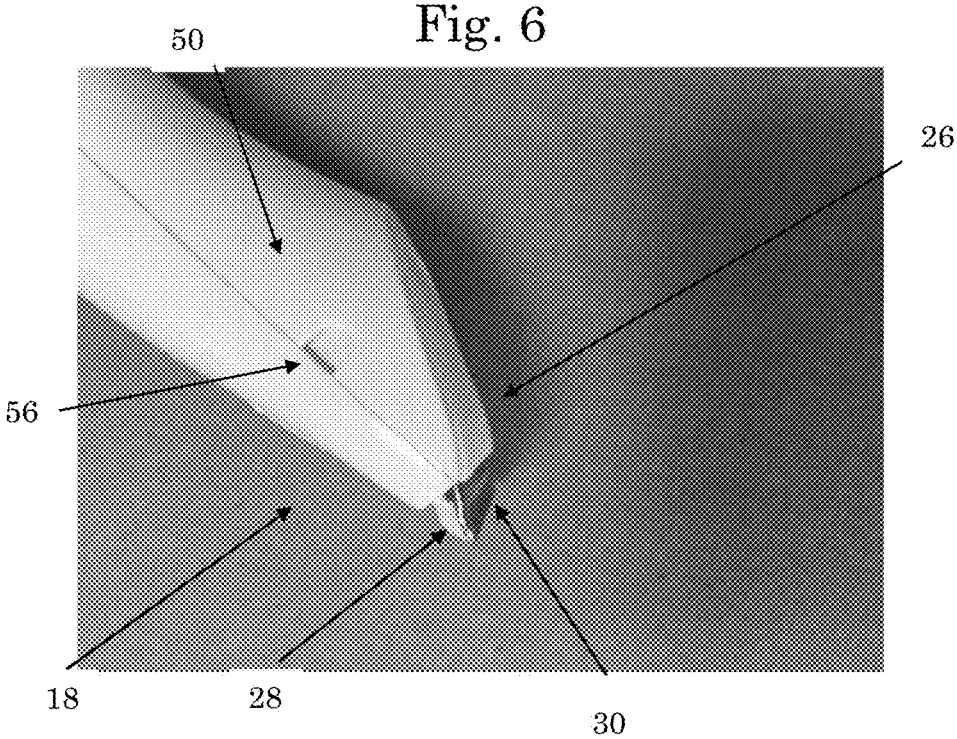
FIG. 6 is a side perspective view of the top end of a body made in accordance with the current disclosure.
Figure 7:
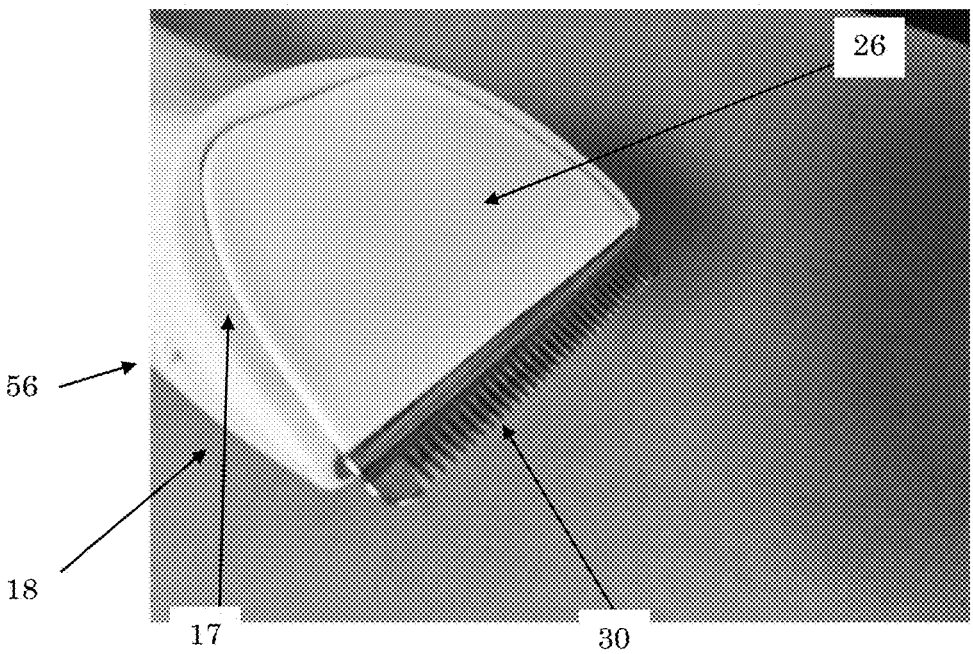
FIG. 7 is a back perspective view of the top end shown in FIG. 6.
Figure 8:
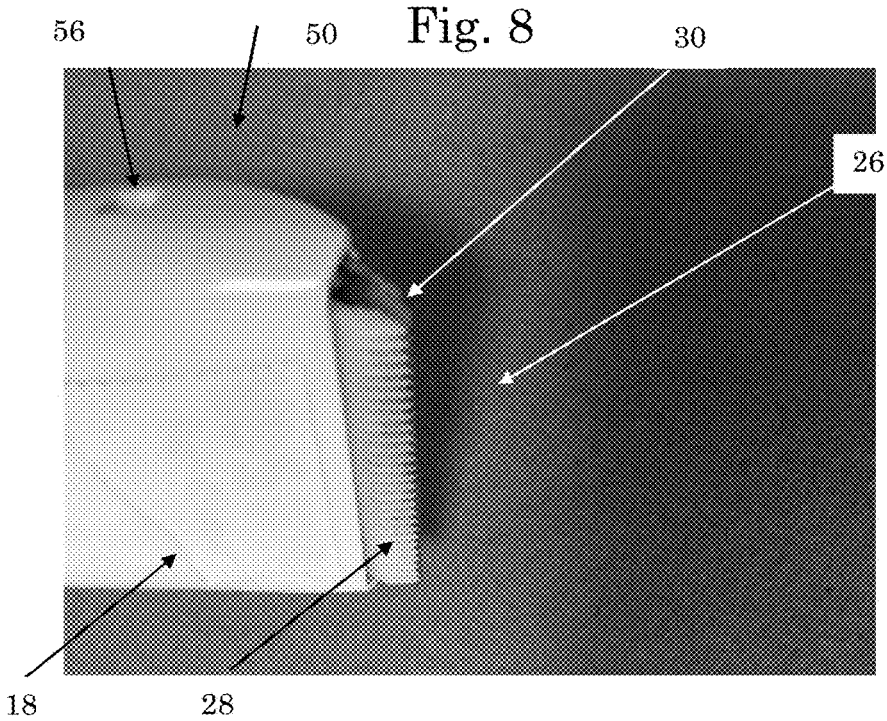
FIG. 8 is a front perspective view of the top end shown in FIGS. 6-7.
Figure 9:
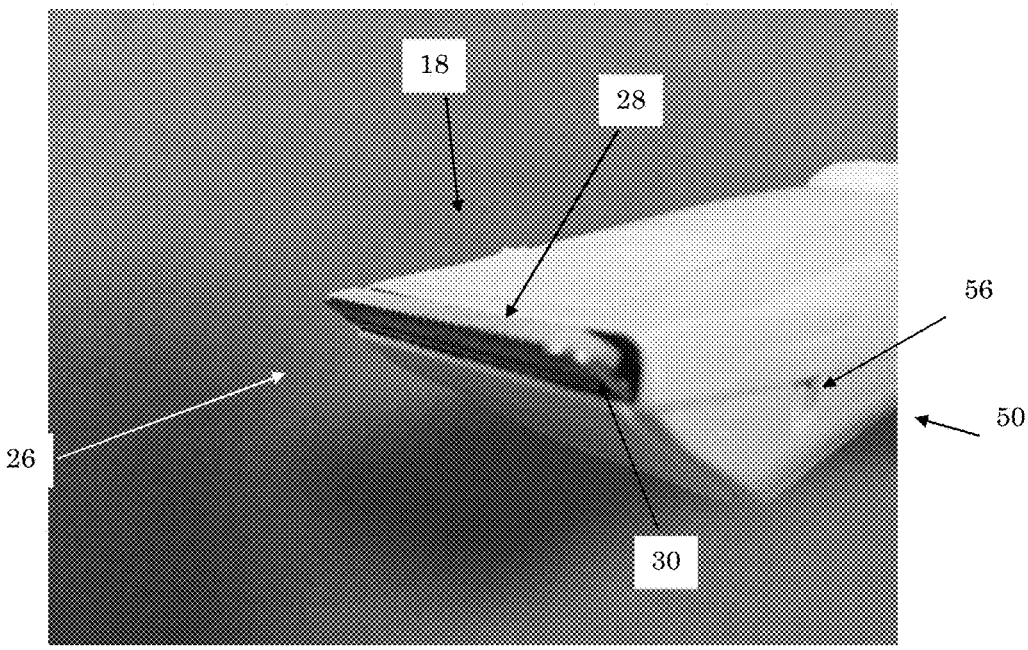
FIG. 9 is a front perspective view of the top end shown in FIGS. 6-8.
Figure 10:
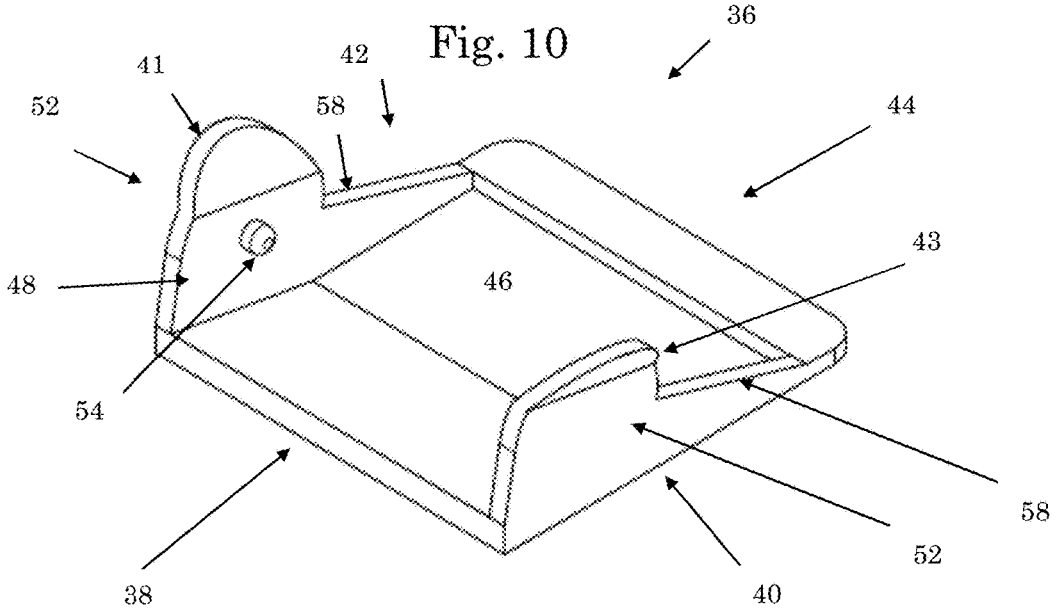
FIG. 10 is a top perspective illustration of a guide made in accordance with the current disclosure.
Figure 11:
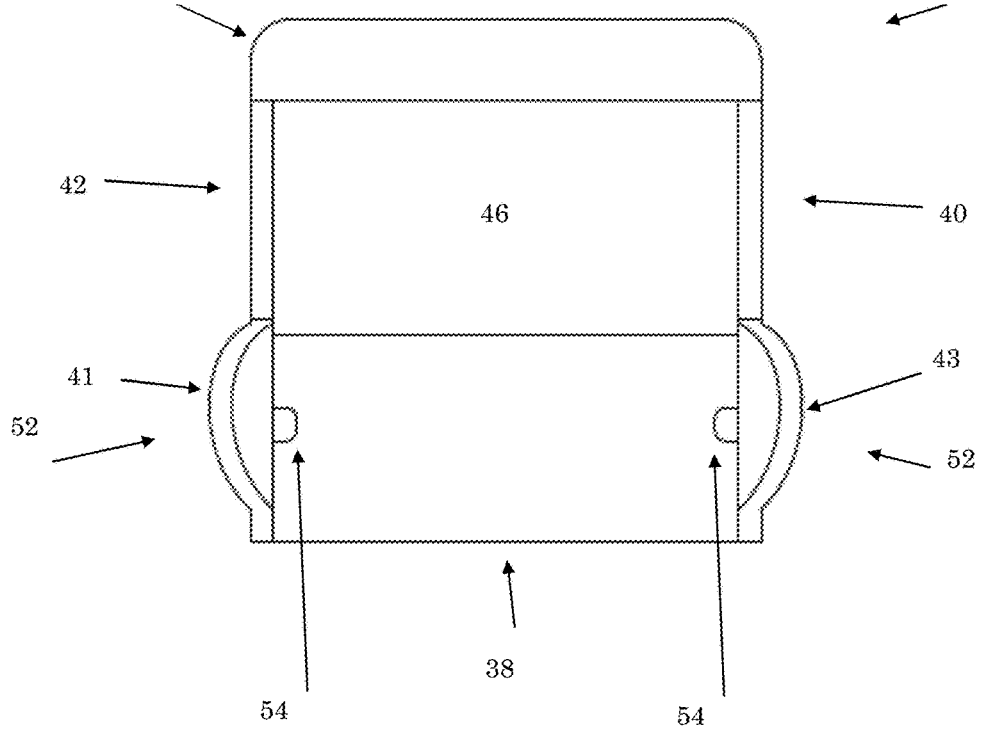
FIG. 11 is a top illustration of the guide shown in FIG. 10.
Figure 12:
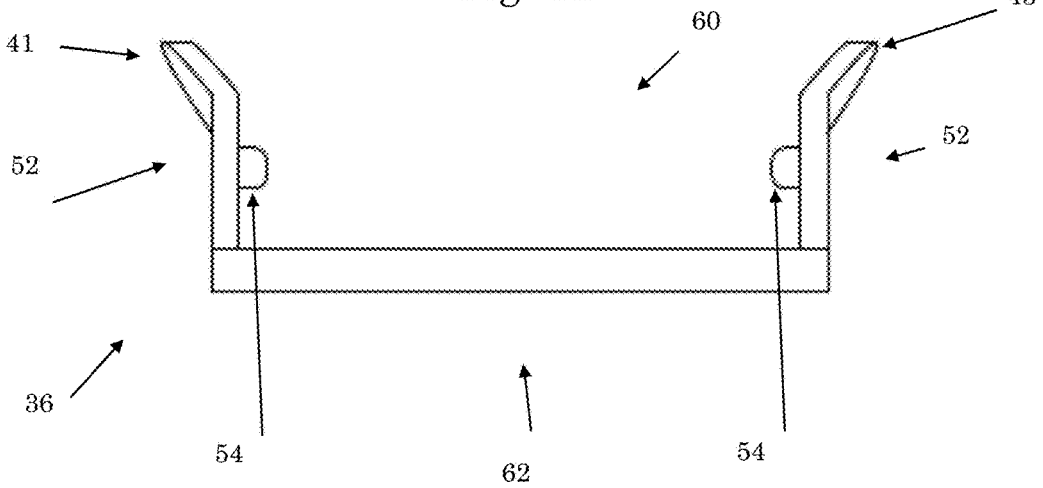
FIG. 12 is a back perspective illustration of the guide shown in FIGS. 10-11.
Figure 13:
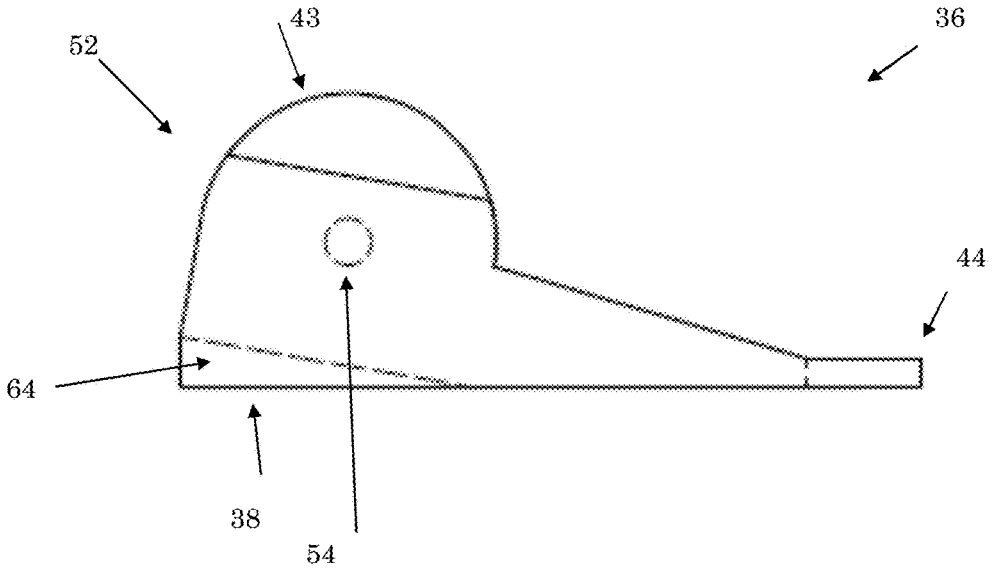
FIG. 13 is a side perspective illustration of the guide shown in FIGS. 10-12.

Referring generally now to the FIGS. 1-17, the current disclosure describes a device 10 for removing the pilling 12 from fabric 14. The fabric can be any textile known in the industry such as nylon, polyester, cotton, blends, wool, etc. The device 10 includes a body 16 having a top end 18, bottom end 20, first side 22, and second side 24. A blade 26 is positioned at the top end 18 of the body 16, wherein the blade 26 has a plurality of upper teeth 28 and a showing of lower teeth 30.

A motor 32 is positioned within the body 16 wherein the motor 32 is operatively attached to the blade 26. A power source 34 is operatively connected to the motor 32.

A guide 36 is also included and attached to the top end 18 of the body 16. The guide 36 includes a base 38 that is wider than the width of the top end 18. First and second armatures 40 and 42 are spaced on opposite sides of the base 38 with each armature 40 and 42 extending from the base 38 in a direction substantially parallel to the other armature 42 or 40. A connector 44 is attached to the armatures 40 and 42 opposite the base 38. The base 38, armatures 40 and 42 and connector 34 define an opening 46 positioned to accept at least part of the blade 26.

Figure 14:
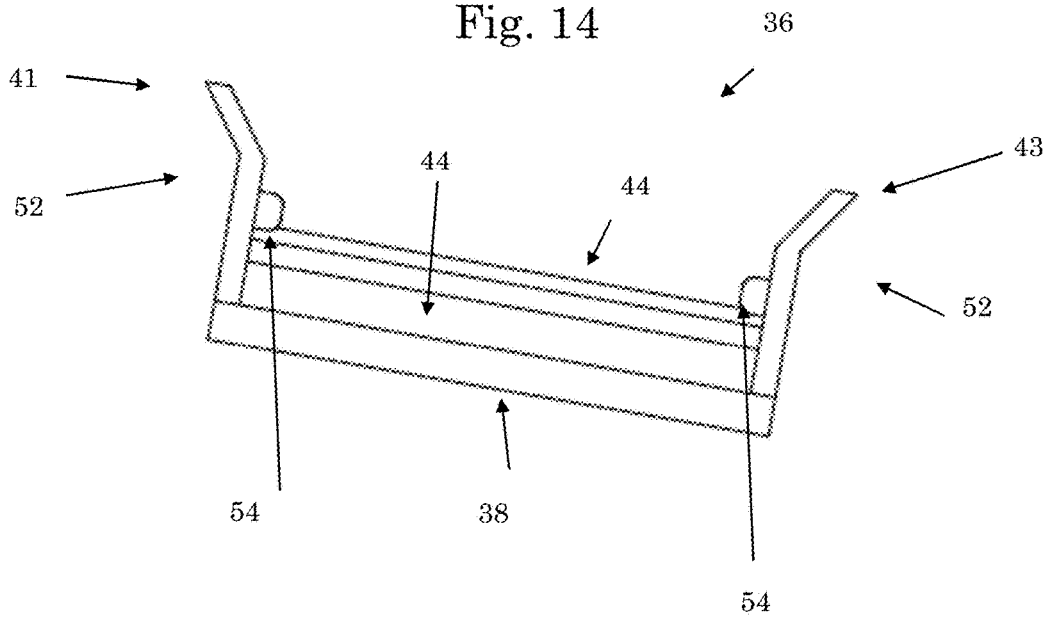
FIG. 14 is a back perspective illustration of the guide shown in FIGS. 10-13.
Figure 15:
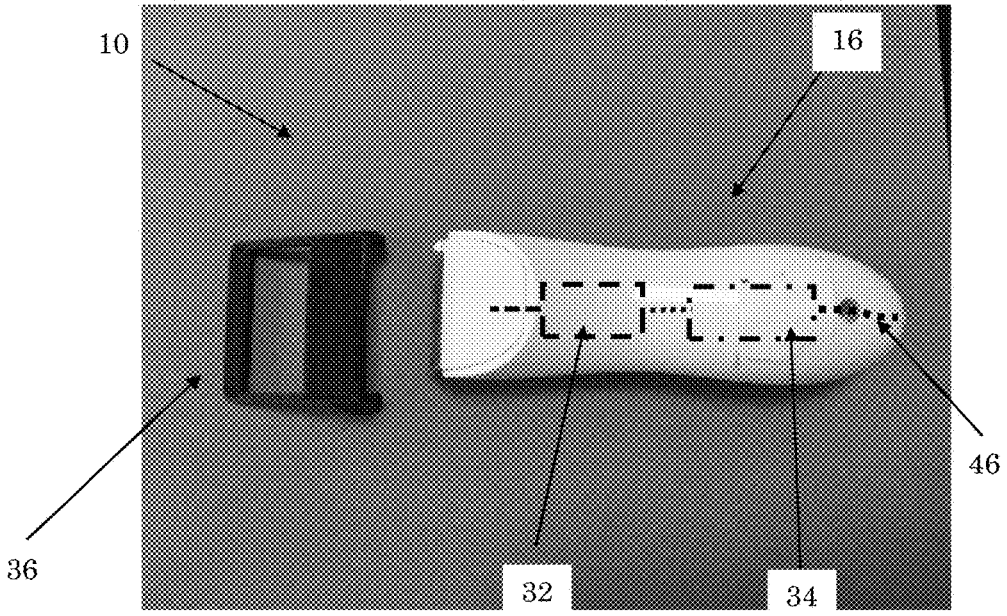
FIG. 15 is a schematic showing the internal elements of an embodiment of a device made in accordance with the current disclosure.
Figure 16:
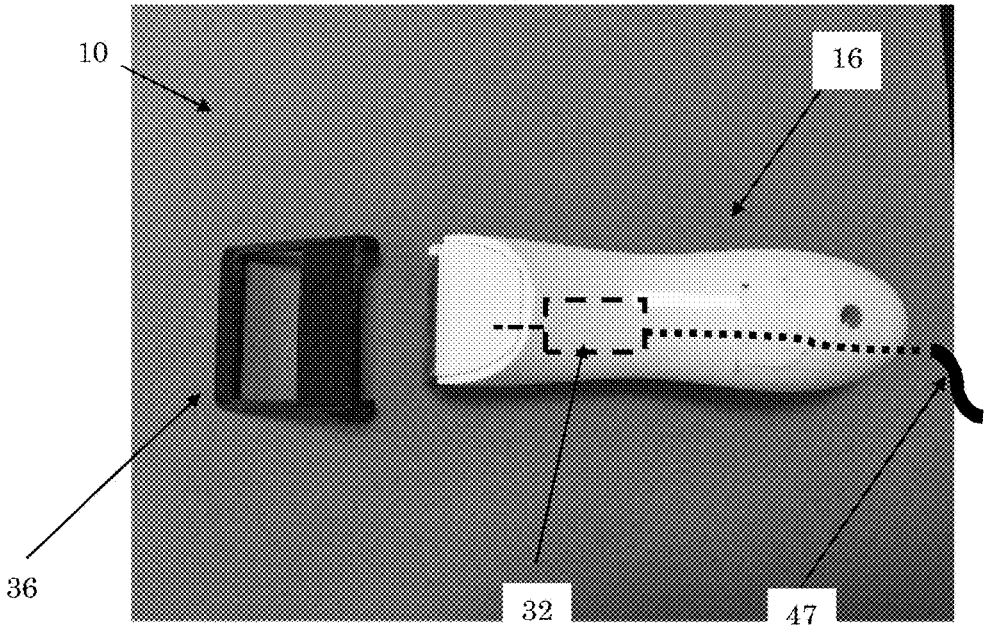
FIG. 16 is a schematic showing an embodiment of the internal aspects of a device made in accordance with the current disclosure.
Figure 17:
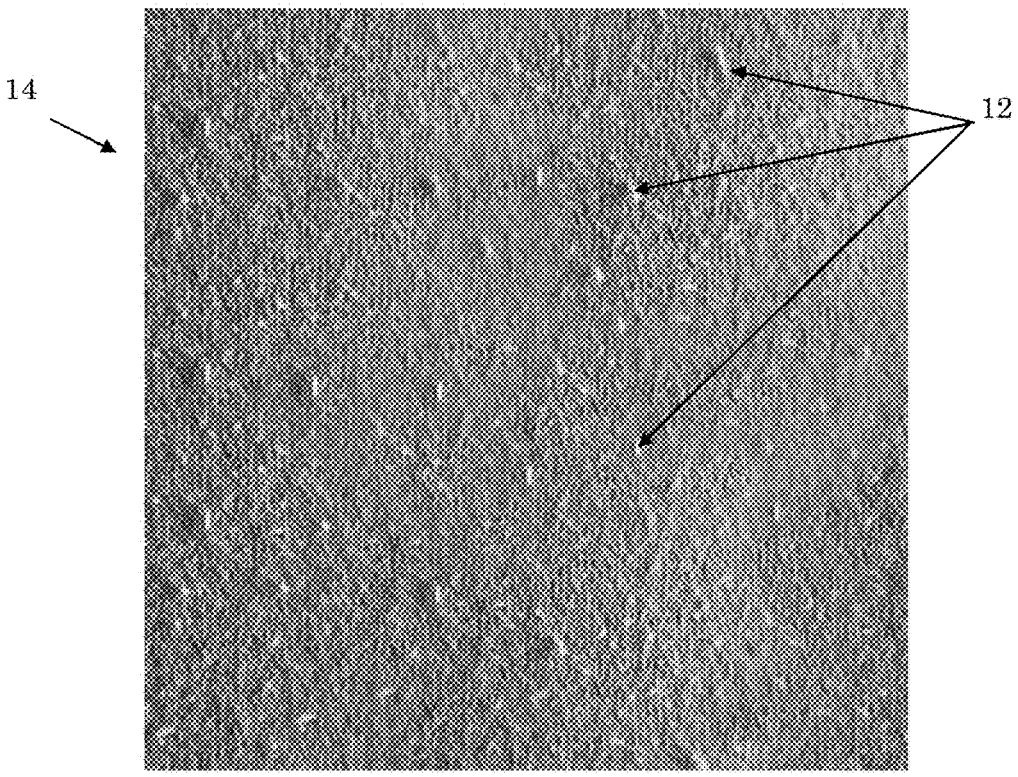
FIG. 17 is an example of pilled material.

In an embodiment, the power source 34 can be contained within the body 16 as shown in FIG. 15 or can be external to the body 16 as shown in FIG. 16. As schematically seen in FIG. 14, the motor 32 can be operatively connected to the blade 26 and can be a motor as standard and known in the art. The power source 34 can be a power source 34 internal to the body 16 such as a DC storage device, such as a battery, or an AC storage device. Alternately, the power source 34 can be as seen in FIG. 15 that has a conduit 47 that carries power to the motor 32. This can also be an AC or DC power source. Alternately, the body 16 can house a converter that can converter power from one form to the other, such as an AC/DC converter. Alternately, the power source 34 as seen in FIG. 15 can be a rechargeable power source and an external conduit, such a 46, can supply power/energy to the power source 34 to power the motor 32 in operation of the device 10.

The blade 26 is operatively connected to the motor 32 such that the motor 32 effectuates movement of the blade 26 to cut the pillings 12 from the fabric 14. The blade 26 can include a plurality of upper teeth 28 and a plurality of lower teeth 30. These plurality 28 and 30 can extend from the top end 18 of the body 16. The upper teeth 28 are preferably comprised of ceramic material. These upper teeth 28 can translate with respect to the plurality of lower teeth 30. For example, the lower teeth 30 can be composed of ceramic material also, or alternately composed of another material, such as metal. The motor 38 can facilitate an oscillation of the upper teeth 28 with respect to the lower teeth 30 such that anything in between the upper teeth 28 and lower teeth 30 can be cut by the movement of the upper teeth 28 relative to the lower teeth 30 as those upper teeth 28 oscillate, and/or translate, across the lower teeth 30.

The guide 36 can be attached the top end 18 of the body 16. Preferably, the guide 36 is removeably attached to the top end 18 of the body 16. The guide 36 can further include at least one guide attachment location 48 positioned proximate the base 38. Correspondingly, the top end 18 can include a device attachment location 50 corresponding to the guide attachment location 48. The guide attachment location 48 and device attachment location 50 are shaped to securely engage one another in order to secure the guide 36 to the top end 18 of the body 16. In an embodiment, this secure attachment can be permanent, while an alternate embodiment attachment can be a removable attachment between the guide 36 and the top end 18 of the body 16.

Accordingly in this removable embodiment, the guide 36 can further include a releasing area 52 positioned proximate to the guide attachment location 48. The releasing area 52 is positioned and shaped to accept a force from a user of the device 10 for removal of the guide 36 to the top end 18. For example, the releasing area 52 can be angled outward such as to readily accept that force from a user such that a user can bias the extensions 41 and 43 of the armatures 40 and 42 to separate a portion of the guide attachment location 48 from the device attachment location 50. A protrusion 54 on the guide attachment location 48 can extend into an orifice 56 of the device attachment location 50. This can removeably secure the guide 36 to the body 16. However, when a force supplied by a user to the releasing area 52, the armatures 40 and/or 42 can bias away from the top end 18 of the body 16 to allow the protrusion 54 to clear the orifice 56 such that the guide 36 can be released from the top end 18.

The armatures 40 and 42 can further include a raise surface 58 that generally extends from approximately the base 38 to the connector 44. This raised surface can add strength to the guide 36 and can help gather and collect pillings 12 removed from the fabric 14.

The guide 36 can further include a topside 60 and bottom side 62. The plurality of lower teeth 30 extend from the top end 18 and are positioned with respect to the guide 36 in the opening 46 such that the lower teeth 30 are substantially flush with the bottom side 62. Alternately stated, the plurality of lower teeth 30 can be substantially planer with the bottom side 62 of the guide 36. This facilitates a proper cutting height of the pilling 12 with a limited chance of cutting the underlying fabric 14.

The guide 36 along with its base 38, first armature 40, second armature 42 and connector 34 define the opening 46. A portion of the blade 26 extends through the opening 46. More particularly, the plurality of upper teeth 28 and plurality of lower teeth 30 extend through the opening 46. This positioning facilitates cutting of the pilling 12 of the fabric 14 as the device 10 is used. The bottom side 62 of the guide 36 can rest against the fabric 14 and provide a proper surface and height for which to move the overall device 10 against the fabric 14. This facilitates a proper cutting of the pilling 12 with the upper teeth 28 and lower teeth 30 positioned a proper height from the fabric 14.

The guide can further include an angled surface 64 positioned proximate the base 38. The angled surface 64 interacts with the top end 18, and more particularly the backside 17 of the top end 18, to position the upper teeth 28 and lower teeth 30 in the opening 46. This angled surface 64 along with the thickness of the connector 44 and armatures 40 and 42 further facilitate positioning of the upper teeth 28 and lower teeth 30 the proper height to cut the pilling 12 of the fabric 14.

Thus, although there have been described particular embodiments of the present invention of a new and useful device to remove pilling from fabric, it is not intended that such references be construed as limitations upon the scope of this disclosure.

What is claimed is:

1. A device for removing pilling from fabric comprising:
a body having a top end, a bottom end, a first side, and a second side;
a blade positioned at the top end of the body, the blade having a plurality of upper teeth and a plurality of lower teeth;
a motor positioned within the body, the motor operatively attached to the blade;
a power source operatively connected to the motor; and
a guide attached to the top end, the guide including:
a base wider than the top end,
first and second armature spaced on opposite sides of the base, each armature extending from the base in a direction substantially parallel to the other armature;
a connector attached to the armatures opposite the base;
wherein the base, first and second armatures, and the connector define an opening positioned to accept part of the blades;
the guide includes a top side and a bottom side; and
the plurality of lower teeth are substantially flush with the bottom side of the guide.

2. The device of claim 1, the opening is positioned to accept the plurality of upper teeth and the plurality of lower teeth.

3. The device of claim 1, the plurality of upper teeth and the plurality of lower teeth extending from the top end of the body.

4. The device of claim 1, the guide further includes a guide attachment location and the top end includes a device attachment location, the guide attachment location shaped to securely engage the device attachment location to attach the guide to the top end.

5. The device of claim 4, the guide further including a releasing area positioned proximate to the guide attachment location, the releasing area positioned and shaped to accept a force from a user of the device for removal of the guide from the body.

6. The device of claim 1, the first and second armatures each include at least one raised surface extending from approximately the base to the connector.

7. A device for removing pilling from fabric comprising:
a body having a top end, a bottom end, a first side, and a second side;
a blade positioned at the top end of the body, the blade having a plurality of upper teeth and a plurality of lower teeth;
a motor positioned within the body, the motor operatively attached to the blade;
a power source operatively connected to the motor; and
a guide attached to the top end, the guide including:
a base wider than the top end,
first and second armature spaced on opposite sides of the base, each armature extending from the base in a direction substantially parallel to the other armature;
a connector attached to the armatures opposite the base; and
wherein the base, first and second armatures, and the connector define an opening positioned to accept part of the blades;
the plurality of upper teeth and the plurality of lower teeth extend from the top end of the body;
the opening is positioned to accept the plurality of upper teeth and the plurality of lower teeth;
the guide includes a top side and a bottom side; and
the plurality of lower teeth are substantially flush with the bottom side of the guide.

8. The device of claim 1, wherein the plurality of upper teeth are comprised of ceramic material and translate with respect to the plurality of bottom teeth.

9. The device of claim 1, wherein the power source is contained within the body.

10. The device of claim 1, wherein the power source is external to the body.

11. A device for removing pilling from fabric comprising:
a body having a top end, a bottom end, a first side, and a second side;
a blade positioned at the top end of the body, the blade having a plurality of upper teeth and a plurality of lower teeth with both pluralities of teeth extending from the top end of the body;
a motor positioned within said body, the motor operatively attached to the blade;
a power source operatively connected to the motor;
a guide removably attached to the top end, the guide including:
a base wider than the top end,
a first armature and a second armature spaced on opposite sides of the base, each armature extending from the base in a direction substantially parallel to the other armature;
a connector attached to the armature opposite the base;
a top side and a bottom side;
wherein the base, first and second armatures, and the connector define an opening positioned to the opening is sized and positioned to accept the plurality of upper teeth and the plurality of lower teeth; and
wherein the plurality of lower teeth are substantially flush with the bottom side of the guide when the guide is attached to the body.

12. The device of claim 11, wherein:
the guide further includes a guide attachment location and the top end includes a device attachment location, the guide attachment location shaped to securely engage to the device attachment location to removably attach the guide to the top end.

13. The device of claim 12, the guide further including a release area positioned proximate to the guide attachment location, the release area positioned and shaped to accept a force from a user of the device for removal of the guide from the body.

14. The device of claim 11, the first and second armatures each include at least one raised surface extending from approximately the base to the connector.

15. The device of claim 11, wherein the plurality of bottom teeth are comprised of ceramic material and linearly oscillate with respect to the plurality of upper teeth.

16. A device for removing pilling from fabric comprising:

a body having a top end, a bottom end, a first side, and a second side;

a blade positioned at the top end of the body, the blade having a plurality of upper teeth and a plurality of lower teeth with both pluralities of teeth extending from the top end of the body;

a motor positioned within said body, the motor operatively attached to the blade;

a power source operatively connected to the motor;

a guide removably attached to the top end, the guide including:

a base wider than the top end, a first armature and a second armature spaced on opposite sides of the base, each armature extending from the base in a direction substantially parallel to the other armature;

a connector attached to the armature opposite the base; and a top side and a bottom side;

wherein the base, first and second armatures, and the connector define an opening positioned to the opening is sized and positioned to accept the plurality of upper teeth and the plurality of lower teeth; and wherein the plurality of lower teeth are positioned within the opening substantially flush with the bottom side of the guide when the guide is attached to the body.

17. The device of claim 16, wherein:

the guide further includes a guide attachment location and the top end includes a device attachment location, the guide attachment location shaped to securely engage to the device attachment location to removably attach the guide to the top end; and the guide further including a release area positioned proximate to the guide attachment location, the release area positioned and shaped to accept a force from a user of the device for removal of the guide from the body.

18. The device of claim 16, the first and second armatures each include at least one raised surface extending from approximately the base to the connector.

* * * * *